United States Patent [19]

Sebardt

[11] 4,171,633

[45] Oct. 23, 1979

[54] ROLLER DEVICE FOR ROLLING MILLS

[75] Inventor: Carl Sebardt, Stockholm, Sweden

[73] Assignee: Stiftelsen FÖR Metallurgisk Forskning, Luleå, Sweden

[21] Appl. No.: 788,895

[22] Filed: Apr. 19, 1977

[51] Int. Cl.[2] ..... B21B 39/06

[52] U.S. Cl. ..... 72/250; 72/222; 226/157; 226/158

[58] Field of Search ..... 72/250, 222, 252, 251, 72/417; 214/1 S, 1 BB, 1.1; 226/157, 158, 422, 428

[56] References Cited

U.S. PATENT DOCUMENTS

| | | | |
|---|---|---|---|
| 459,374 | 9/1891 | Gooding et al. | 226/157 |
| 3,630,061 | 12/1971 | Wilson | 72/252 |

FOREIGN PATENT DOCUMENTS

| | | | |
|---|---|---|---|
| 2603345 | 2/1977 | Fed. Rep. of Germany | 72/250 |
| 42-14069 | 8/1967 | Japan | 72/250 |
| 43-27850 | 3/1968 | Japan | 72/252 |

*Primary Examiner*—Milton S. Mehr

*Attorney, Agent, or Firm*—Larson, Taylor and Hinds

[57] ABSTRACT

A device for gripping and guiding a bar of material into the nip of the rolls of a rolling mill. At least two opposed guide rollers are moveably mounted on an appropriate support, such as a gripping arm of a manipulator head for a rolling mill. The guide rollers are moveable towards one another into a gripping position for gripping the edges of a bar of material being introduced into the rolling mill nip. The guide rollers are moveable away from one another and out of engagement with the bar of material. A bar is readily gripped by the opposed rollers and is quite free to be advanced into the roller nip since the guide rollers are free to rotate. One or more rollers may include a ratchet to prevent rotation in the opposite direction such that any tendency of a bar of material to be thrown back out of the roll nip will be resisted.

9 Claims, 3 Drawing Figures

ROLLER DEVICE FOR ROLLING MILLS

The present invention relates to a rolling device in rolling mills, for guiding material to be rolled into roll grooves.

In conventional rolling mills, a guide bar and guiding rails are used for steering the material to be rolled between the rollers. In a special type of rolling mills with a manipulator, the material for rolling is handled during rolling by means of a gripper with clamping plates for gripping material. To steer the material between the rollers one must, however, combine the gripper with the conventional guide bar in such rolling mills.

The present invention has the object of providing a roller device for rolling mills to steer the material to be rolled in between the rollers, this rolling device replacing the conventional guide bar and guiding rails or the guide bar and gripper.

The rolling device according to the invention is characterized by at least two guide rollers, rotatable about their axes and displaceable towards and away from each other, said rollers being arranged so that with their circular surfaces they retain and guide the material to be rolled in between the rollers.

According to an especially preferred embodiment of the invention, the rollers are provided with ratchets. The rotational axes of the rollers are preferably generally perpendicular to the rotational axes of the rolls. According to a special characterizing feature of the invention, the circular surfaces of the rollers are concave, especially V-shaped. The number of rollers is suitably four, the rollers being arranged displaceable in pairs towards and away from each other, and according to a suitable embodiment, each of both roller pairs is pivotably mounted on a shaft substantially parallel to the axes of the rollers.

The grippers with clamping plates, used in known rolling mills for handling material to be rolled, give friction between the material or billet when it is drawn into the roll groove. By using a rolling device with rotating rollers according to the invention, this friction is instead avoided, and by providing the rollers with ratchets according to a special embodiment, they can push the material to be rolled in between the rolls, similarly to the gripper with clamping plates. The V-shaped circular surface of the rollers allows them to provide support for the material to be rolled so that the conventional guide bar can be dispensed with.

The invention will now be described in detail in the following while referring to the appended drawing, on which an embodiment of the invention is schematically illustrated as an example.

FIG. 1 on the drawing is a side view of the invention, and illustrates the position of the roller device in relation to the rolls and the guide channel for the material to be rolled, as well as illustrating the suspension of the roller device.

Figure 1:
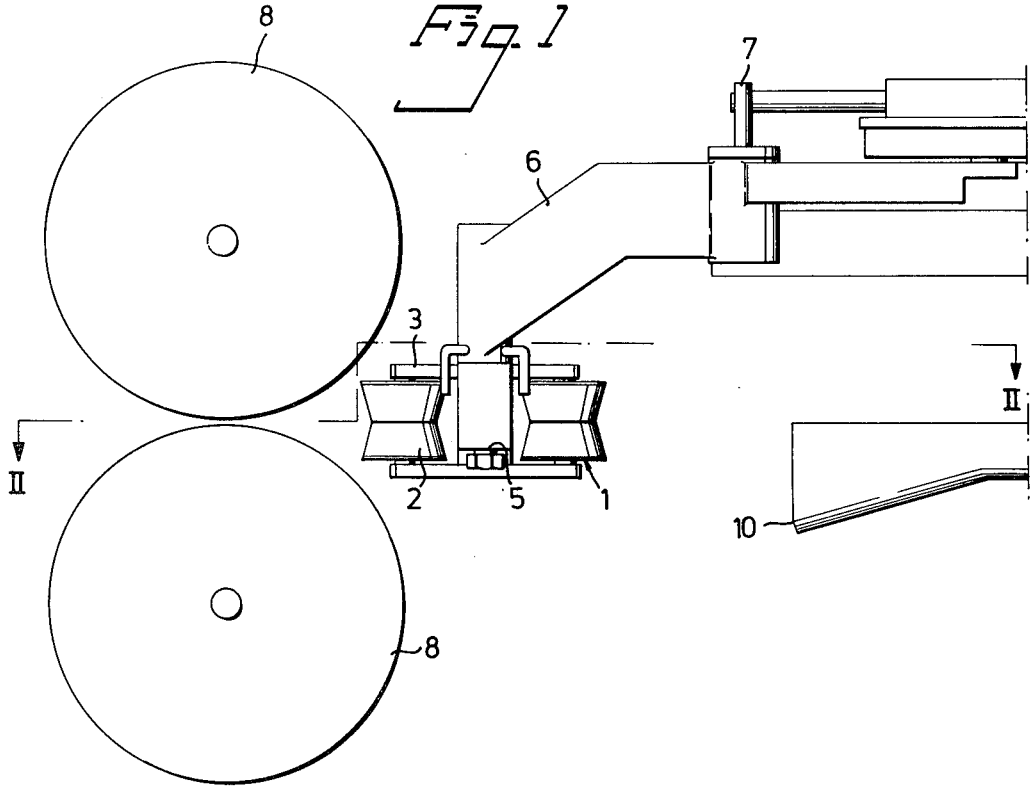
Figure 3:
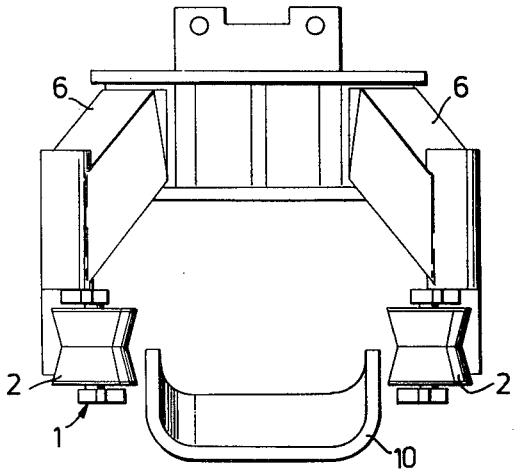
FIG. 3 is an end view of the roller device and guide channel.
Figure 2:
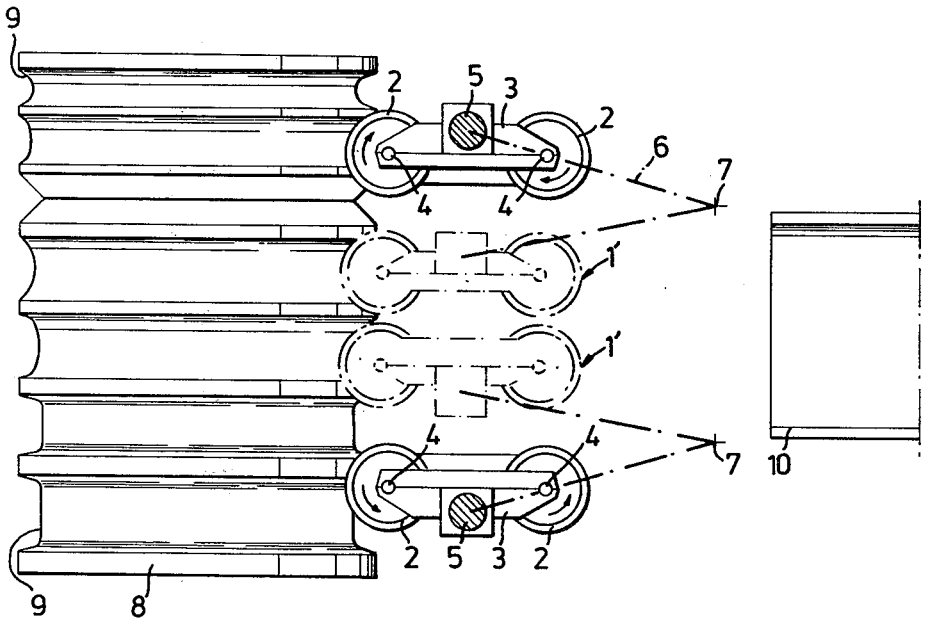
FIG. 2 is a sectional view along the line II—II in FIG. 1.

The roller device 1 illustrated on the drawing consists of four rollers 2, mounted in pairs through their rotational axes 4, each pair in a frame 3. In turn, both frames 3 are each pivotably mounted on a shaft 5, the shafts each being mounted and supported in a gripping arm 6 in a manipulator head for a rolling mill. The rollers 2 are provided with ratchets so that they can only rotate in one direction, i.e. according to the arrows in FIG. 2. Each of the gripping arms 6 is pivotably mounted on a shaft 7 in the manipulator head. In FIG. 2, the full lines denote the position of both halves of the roller device when the gripping arms 6 assume their outwardly swung attitudes, while the chain-dotted lines denote the attitude of the roller device halves when the gripping arms 6 assume their inwardly swung attitudes.

The roller device 1 is centered opposite the nip between two rolls 8 having seven roll grooves 9, intended for rolling a billet 90 mm square into a bar of 50 mm diameter. On the side of the roller device 1, remote from the rolls, there is arranged a guide channel 10 to receive the billet coming to and from the rolls 8.

When a billet is to be rolled, it is gripped with the help of the roller device 1 by both the roller device halves being moved together into the attitude 1' shown by chain-dotted lines in FIG. 2. The roller device with the gripped billet is then lined up with the bottom roll groove 9 in FIG. 2, by the unit in which the roller device and the guide channel 10 are incorporated in the maniuplator head being displaced transversely. Since the circular surface of the rollers 2 is V-shaped and since the rollers are four in number, i.e. two on either side of the billet, the roller device is given a fast and steady grip on the billet and can guide the billet into the roll groove without difficulty, and when the rolls have gripped the billet for pulling it through, the rollers 2 do not exert any friction on the billet, since they are freely rotatable in the feeding direction of the billet towards the rolls. Since, on the other hand, the rollers 2 have ratchets hindering rotation in the other direction, they prevent the billet being thrown back from the nip. When reversing the billet, the roller device halves are moved apart and the billet is steered in onto the guide channel 10, and on subsequent rolling through the next roll groove, the procedure described above is repeated.

Hereinbefore there has been described a special embodiment of a roller device according to the invention, having all the advantages of the inventive subject, but the invention is not limited to this one special embodiment, and may embrace all the embodiments falling within the scope of the patent claims.

I claim:

1. A roller device for gripping the edges of a bar of material and for guiding the bar of material into a nip between rolls of a rolling mill, said roller device comprising:

support means adapted to be maintained in position on one side of a pair of rolls of a rolling mill;

at least two pairs of opposed guide rollers moveably mounted on said support means, each of said pairs of opposed rollers being moveable towards one another into a gripping position with said pairs of rollers, opposed to one another, for gripping therebetween the edges of a bar of material being introduced into a nip on said one side of the rolls of a rolling mill, and each of said pairs of opposed guide rollers being moveable away from one another and into a disengaged position out of engagement with said bar of material;

said support means comprising a shaft, each pair of rollers being pivotally mounted on said shaft, said shaft being generally parallel to the axes of the rollers of its respective pair of rollers; and means for moving said guide rollers between said gripping and disengaged positions.

2. A roller device according to claim 1 wherein said guide rollers are freely rotatable in at least one direction.

3. A roller device according to claim 2 further comprising means preventing rotation of at least one of said guide rollers in one direction whereby a bar of material gripped at its edges by said guide rollers is restrained from being thrown back out of a roll nip of the rolling mill into which it is being guided.

4. A roller device according to claim 3 wherein said rotation preventing means comprises a ratchet.

5. A roller device according to claim 3 wherein each of said guide rollers comprises a concave roller surface.

6. A roller device according to claim 3 wherein each of said guide rollers comprises a V-shaped roller surface.

7. A roller device according to claim 1 further comprising means for moving the guide rollers in the direction of travel of the bar of material to be rolled.

8. A roller device according to claim 1 wherein the said guide rollers are mounted such that, in said gripping position, the axes of said guide rollers are generally perpendicular to the axes of the rolls of the rolling mill.

9. A roller device according to claim 8 further including means for moving said guide rollers in the direction of travel of the material to be rolled whereby a bar of material gripped by said guide rollers may be moved towards the nip of said rolling mill.

* * * * *